US006158581A

United States Patent [19]

Hong

[11] Patent Number: 6,158,581

[45] Date of Patent: Dec. 12, 2000

[54] GOLF BAG

[76] Inventor: Bum-Ki Hong, 105-903, Hyundai first APT., 653 Gaepo-dong, Kangnam-gu, Seoul, Rep. of Korea

[21] Appl. No.: 09/132,222

[22] Filed: Aug. 11, 1998

[30] Foreign Application Priority Data

| | | | |
|---|---|---|---|
| Aug. 12, 1997 | [KR] | Rep. of Korea | 97-21906 |
| Feb. 12, 1998 | [KR] | Rep. of Korea | 98-1781 |
| Mar. 24, 1998 | [KR] | Rep. of Korea | 98-4343 |

[51] Int. Cl.[7] ..... A63B 55/00

[52] U.S. Cl. ..... 206/315.3; 206/315.6; 206/315.8

[58] Field of Search ..... 206/315.3–315.6, 206/315.8

[56] References Cited

U.S. PATENT DOCUMENTS

| | | | |
|---|---|---|---|
| 3,674,072 | 7/1972 | Shuto | 206/315.6 |
| 5,228,566 | 7/1993 | Shenoha | 206/315.7 X |
| 5,544,743 | 8/1996 | Hong | 206/315.6 |
| 5,769,220 | 6/1998 | Hong | 206/315.8 X |
| 5,772,024 | 6/1998 | Lueders | 206/315.3 X |

*Primary Examiner*—Sue A. Weaver
*Attorney, Agent, or Firm*—Abelman, Frayne & Schwab

[57] ABSTRACT

A golf bag, provided with a plurality of club inlet openings and club head shields at its top frame, is disclosed. In the golf bag, irons, woods, a pitching wedge, a sand wedge and a putter, are separately and neatly adjusted in the order of different lengths of the clubs. The club shafts are inserted into the bag through the openings, while the club heads are held in the head shields. Both the shafts and heads of the clubs are thus prevented from being moved or tangled in the golf bag, so that a golfer easily selects a desired club from the bag prior to hitting a golf ball on the course. The golf bag also prevents the club heads from colliding against each other, thus preventing the club heads from being damaged. The golf bag also allows a golfer to check empty head shields of his bag at a look, so that the golf bag prevents any club heads from being lost.

5 Claims, 10 Drawing Sheets

GOLF BAG

BACKGROUND OF THE INVENTION

1. Field of the Invention

The present invention relates, in general, to golf bags and, more particularly, to a golf bag provided with both a partitioned inlet opening and a partitioned head shield for clubs at the top frame, thus allowing a golfer to easily, orderly and neatly adjust his clubs in the bag and allowing the golfer to easily select a desired club from the bag prior to hitting a golf ball on the course, the golf bag also almost completely preventing club heads from being damaged or lost.

2. Description of the Prior Art

As well known to those skilled in the art, a typical golf bag is open at the top to receive the shafts of golf clubs. The body of such a golf bag typically is integrated with two frames: synthetic resin top and bottom frames. The bag body is also covered with a cloth or leather cover. A shoulder strap is attached to the side wall of the golf bag, thus allowing a golfer to carry the bag on his shoulder as he moves about the course.

However, such typical golf bags are not provided with any means for orderly and neatly adjusting golf clubs in the bag, so that the club heads get entangled at the top of the bag. This prevents a golfer from easily selecting a desired club from the bag prior to hitting a golf ball on the course. The above golf bags also allow the club heads to collide against each other as the golfer moves about the course with the bag on his shoulder. In such a case, the club heads may be damaged. In addition, it is almost impossible for a golfer to easily confirm at a look whether his golf clubs are safely kept in the bag.

SUMMARY OF THE INVENTION

Accordingly, the present invention has been made keeping in mind the above problems occurring in the prior art, and an object of the present invention is to provide a golf bag, which is provided with a plurality of the club inlet openings and club head shields at the top frame, thus allowing a golfer to easily, orderly and neatly adjust his clubs in the bag and allowing the golfer to easily select a desired club from the bag prior to hitting a golf ball on the course, and which also almost completely prevents club heads from being damaged or lost.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
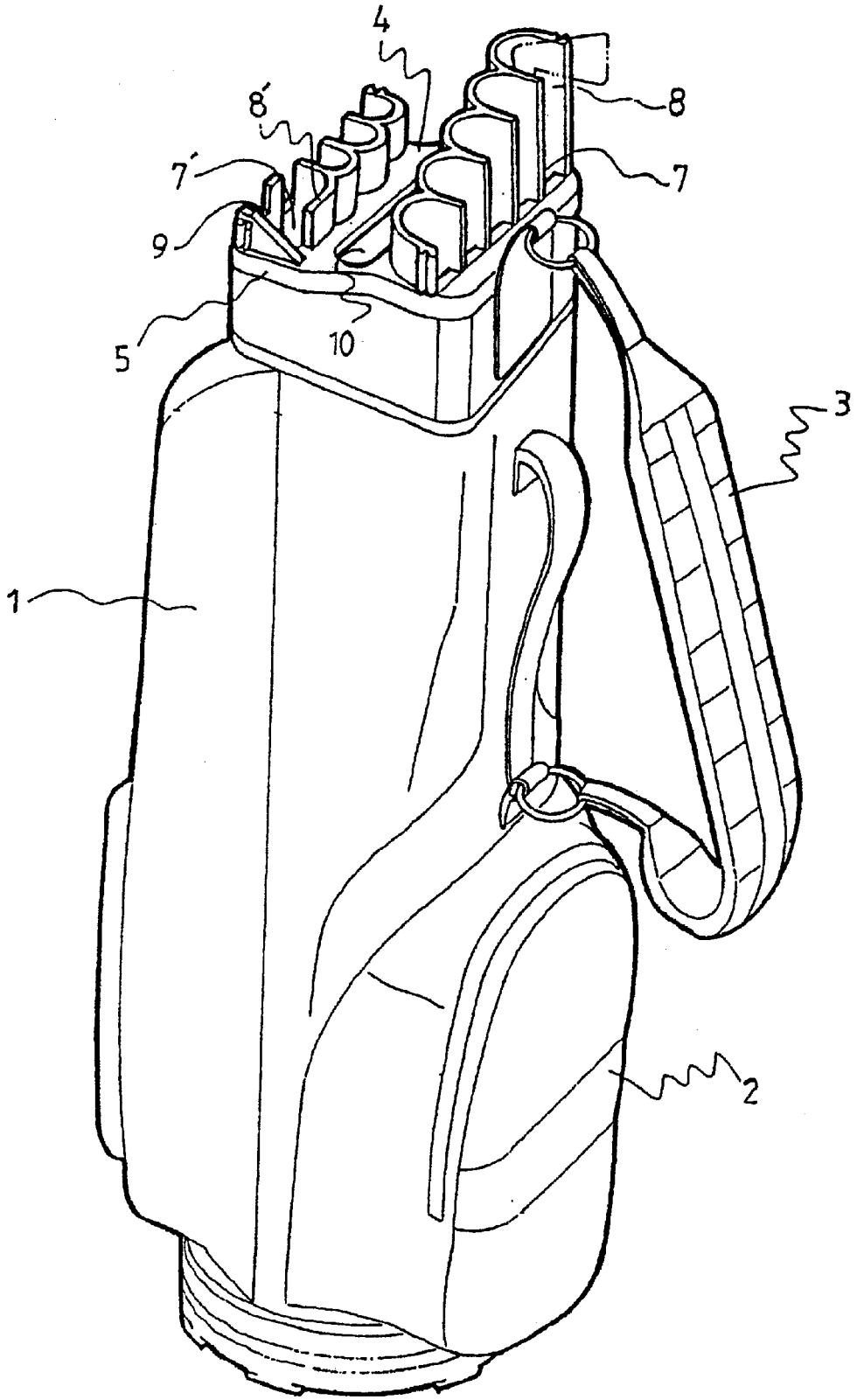
FIG. 1 is a perspective view showing the appearance of a golf bag in accordance with the primary embodiment of the present invention.
Figure 2:
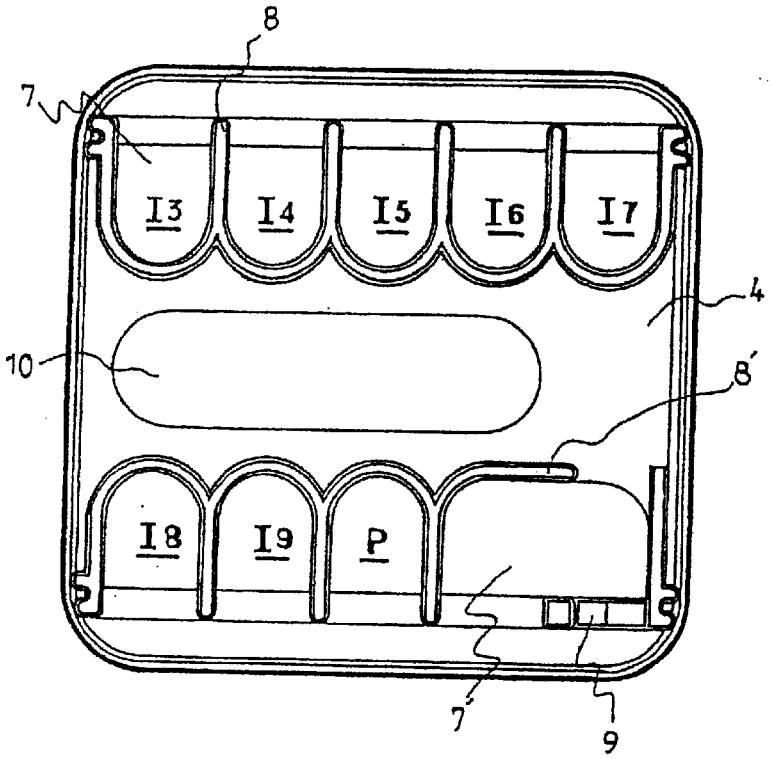
FIG. 2 is a plan view showing a top frame of the golf bag according to this invention.
Figure 3:
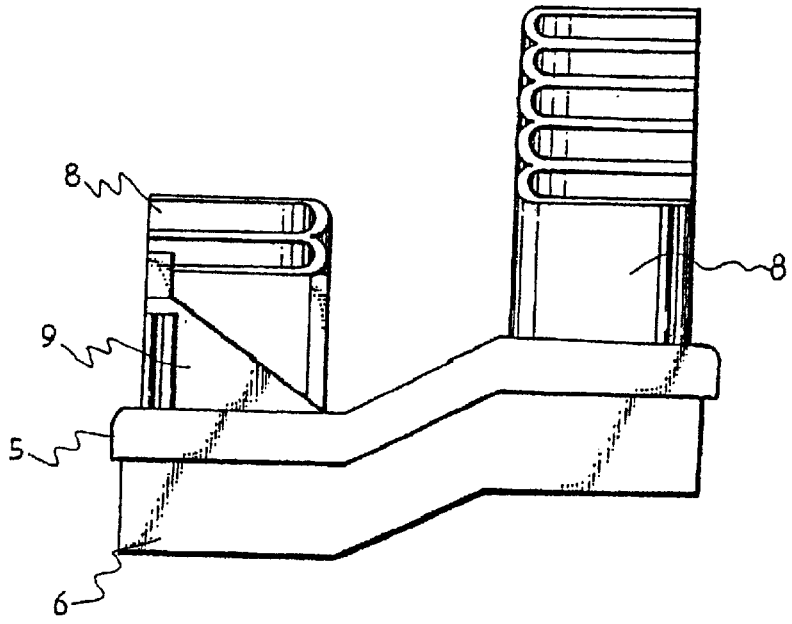
FIG. 3 is a left-side view of the top frame of the golf bag according to this invention.
Figure 4:
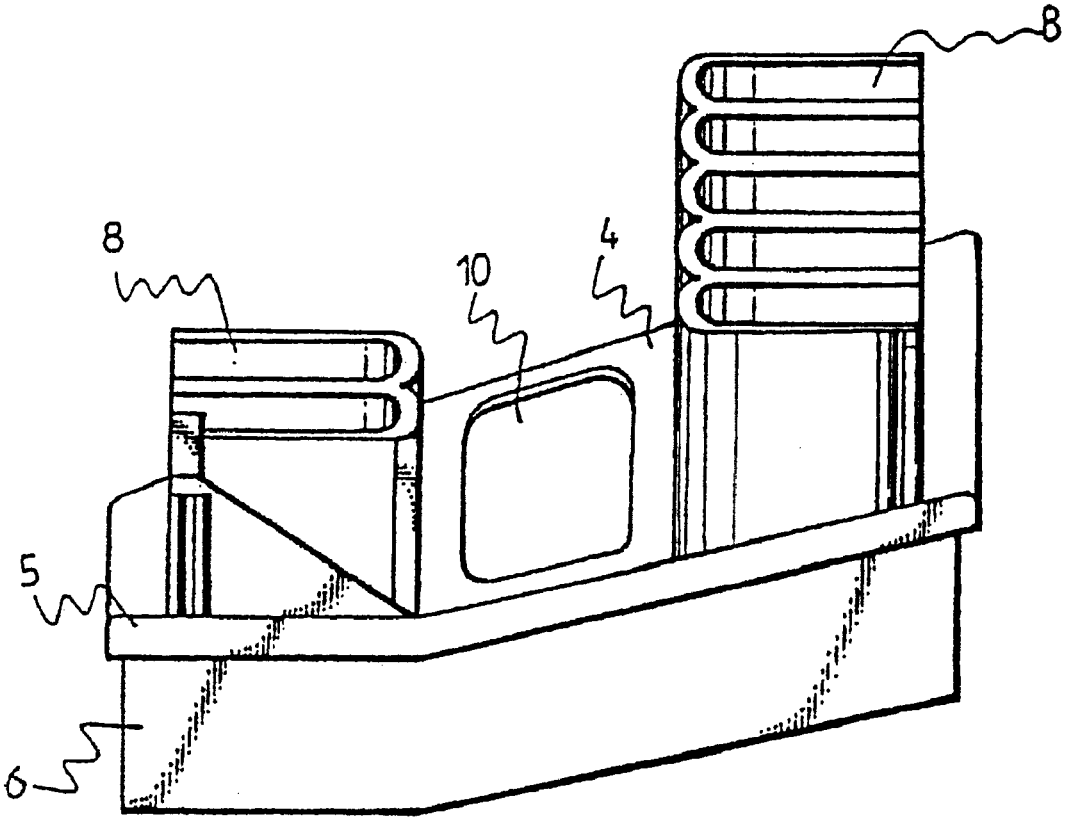
FIG. 4 is a left-side view of a golf bag's top frame in accordance with another embodiment of this invention.

FIG. 1 is a perspective view showing the appearance of a golf bag in accordance with the primary embodiment of the present invention. FIG. 2 is a plan view showing a top frame of the above golf bag. FIG. 3 is a left-side view of the above top frame. FIG. 4 is a left-side view of a golf bag's top frame in accordance with another embodiment of this invention.

As shown in the drawings, the golf bag of this invention comprises a bag body 1 which is integrated with a top frame 4 into a single structure.

The above bag body 1 is typically made of synthetic resin through a molding process and has a hollow rectangular column shape. The above bag body 1 is tightly covered with a cloth or leather cover. A plurality of pockets 2 are exteriorly provided on the side wall of the cover at predetermined positions. The above pockets 2 are for keeping golfer's necessaries, such as golf balls, golf tees, ball markers and gloves, in the golf bag. A shoulder strap 3 is attached to the side wall of the golf bag, thus allowing a golfer to carry the bag on his shoulder as he moves about the course. In order to integrate the bag body 1 with the top frame 4, the top edge of the bag body 1 covered with the cloth or leather cover is inserted into the girdle 5 of the top frame 4 prior to integrating the top edge of the body with the skirt 6 of the frame 4 using a plurality of rivets.

The top frame 4 has a plurality of first head shields 8, respectively used for keeping the heads of number three to seven irons, inside its front wall to which the should strap 3 is connected. The above head shields 8, having different heights corresponding to the different lengths of the above irons and individually having a U-shaped cross-section, are integrated into a single body while being arranged along a line in the order of their heights. The above head shields 8 also individually have a club inlet opening 7 and are open in a direction toward the front of the top frame 4.

The above top frame 4 also has a plurality of second head shields 8 and 8' for number eight and nine irons, a pitching wedge, a sand wedge and a putter inside its rear wall. The second head shields 8 and 8', individually having a U-shaped cross-section, are integrated into a single body while being arranged along a line in the order of different lengths of the above clubs, wedges and putter kept in the shields 8 and 8'. The above head shields 8 and 8' also individually have a club inlet opening 7, 7' and are open in a direction toward the back of the top frame 4. Since the shaft of a putter typically has a specifically bent configuration, so that it is necessary for the putter to be kept in a larger cavity. Therefore, the two inlet openings 7' for the sand wedge and the putter are designed for communicating with each other without having any partition wall between them, thus allowing the shaft of a putter to be more effectively kept in its head shield 8'. That is, as shown in FIGS. 1 to 3, the head shield 8' for a sand wedge is defined inside the top frame 4, while the inlet openings 7' for the sand wedge and the putter are integrated into a single opening. In addition, a putter hanger 9 is formed on the rear wall of the above single opening 7' at a position for the head of a putter.

The length of typical irons is gradually reduced by ½ inch in inverse proportion to the iron number, while the length of a pitching wedge is equal to that of a sand wedge. In this regard, the head shields 8 for the number three iron to the pitching wedge are designed for being gradually reduced in their heights by ½ inch. The head shields 8 and 8' for the pitching and sand wedges have the same height. Since a typical putter is shorter than a sand wedge, the top edge of the putter hanger 9 is positioned higher than the inlet opening 7' for a putter, thus allowing a putter to be stably hung on the hanger 9.

A longitudinal center opening 10 is formed on the top wall of the top frame 4, thus allowing a plurality of woods to be kept in the bag. However, the above opening 10 is designed so that its inside end does not exceed an area aligned with the putter hanger 9.

As shown in FIG. 3, the above girdle 5 of the top frame 4 may be started at a reference position, which is lower than the top edge of the head shield 8' for a sand wedge by about 4–5 cm. In such a case, the girdle 5 extends along the side wall of the frame 4 with the position of the girdle 5 around the front portion of the frame 4 being higher than the position of the girdle 5 around the rear portion. Alternatively, as shown in FIG. 4, the girdle 5 of the top frame 4 may be formed at a reference position, which is lower than the top edge of each of the head shields 8 by about 4–5 cm. In such a case, the top all of the frame 4 is formed as a flat panel, which is leveled with the top edge of the girdle 5 and leaves both the center opening 10 and the inlet openings 7 thereon.

When a golf club is received into the golf bag through an associated inlet opening 7, the shaft of the club is not moved since the openings 7 are isolated from each other by partition walls. In addition, the height of a club head is equal to that of an associated head shield 8, so that different club heads are stably kept in their head shields 8, thus being effectively restricted from moving in the shields 8. In the golf bag, a putter head is caught by the putter hanger 9 at its front portion. In such a case, the rear portion of the putter head is laid on the top wall of the frame 4 at a position free from the center opening 10.

Figure 5:
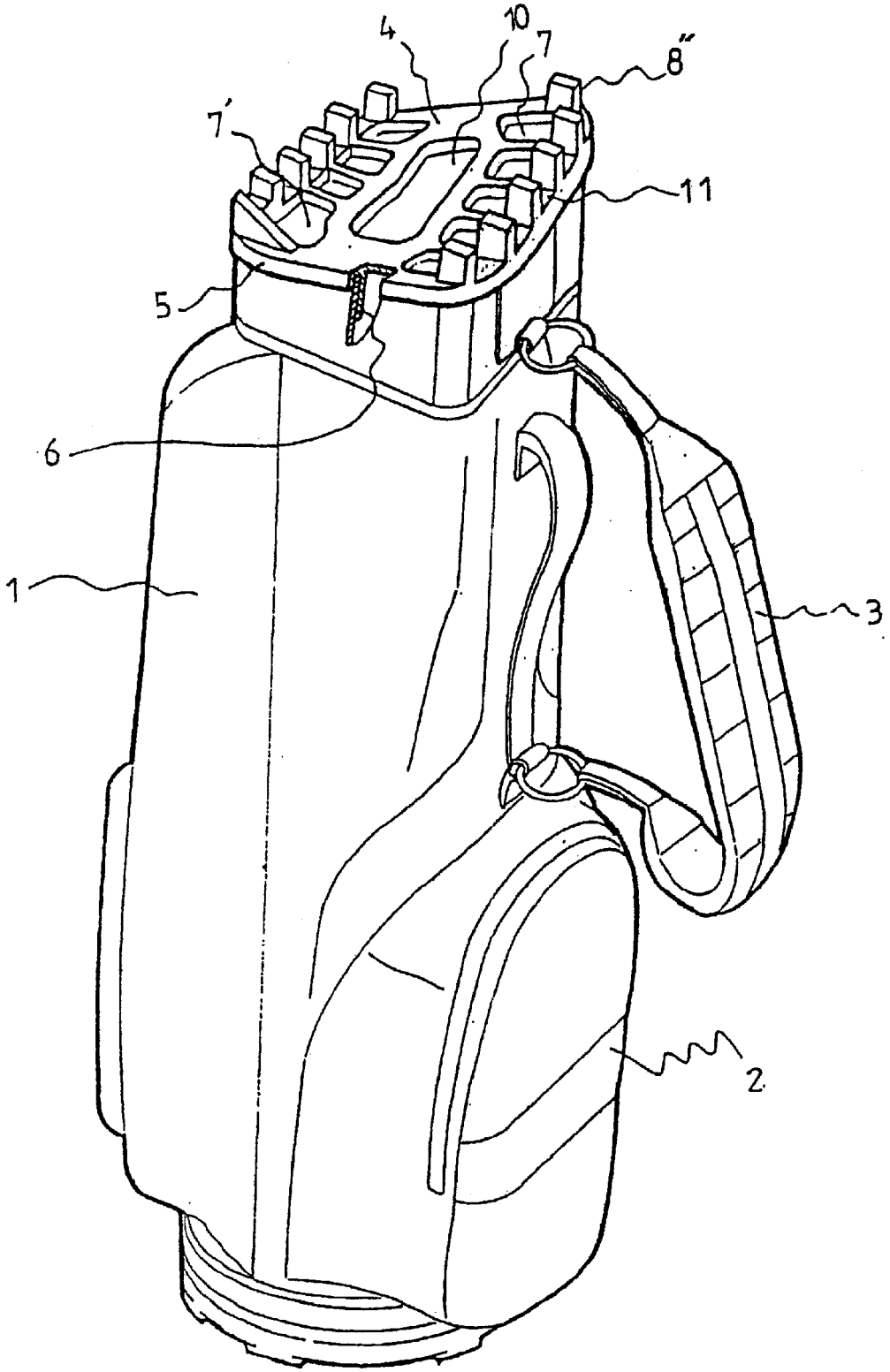
FIG. 5 is a perspective view showing the appearance of a golf bag in accordance with the second embodiment of the present invention.
Figure 6:
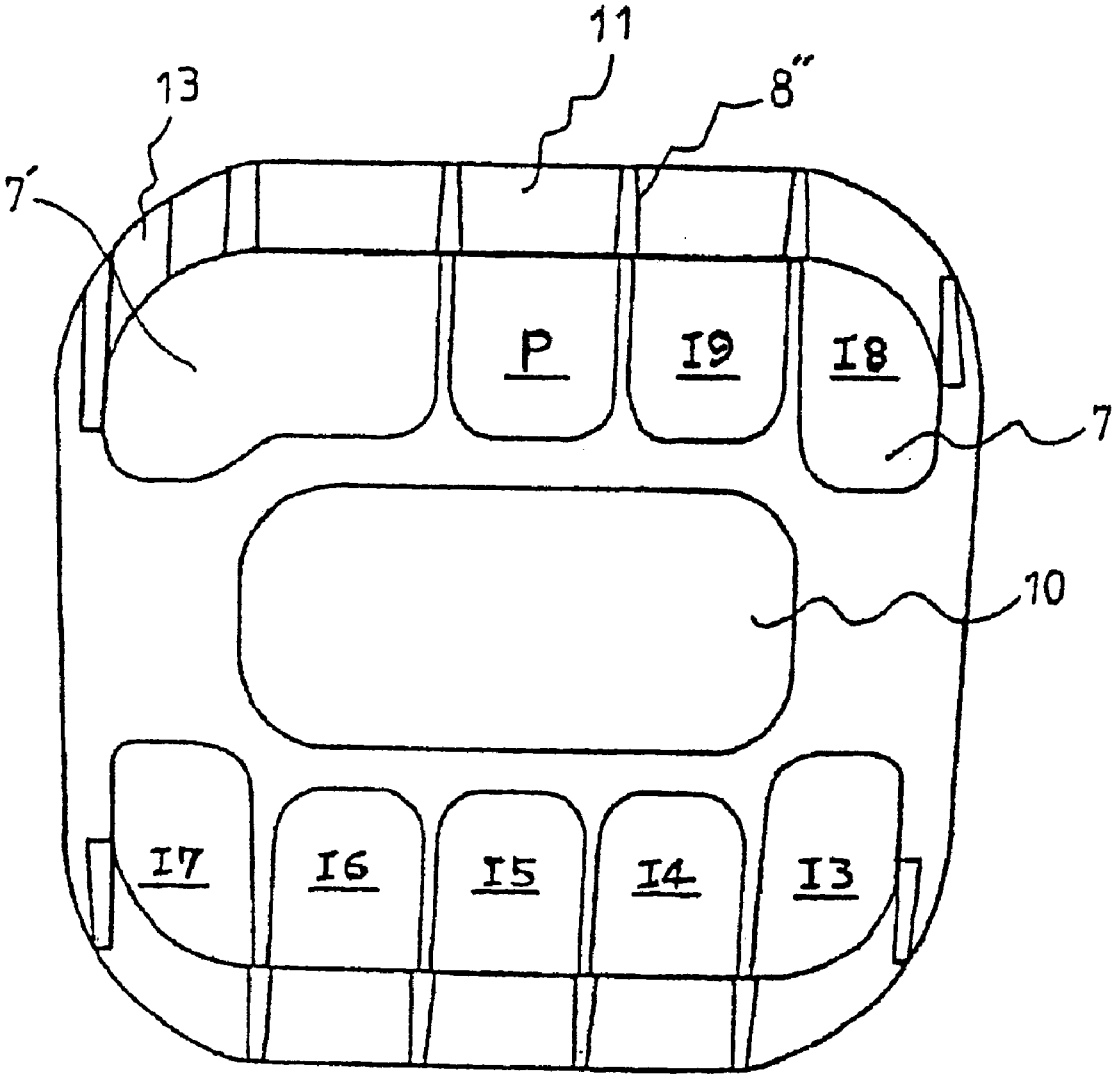
FIG. 6 is a plan view showing a top frame of the golf bag of FIG. 5.

FIG. 5 is a perspective view showing the appearance of a golf bag in accordance with the second embodiment of this invention. FIG. 6 is a plan view showing the top frame of the golf bag of FIG. 5.

As shown in FIGS. 5 and 6, the golf bag according to this embodiment comprises a bag body 1 integrated with a top frame 4 into a single structure.

The above bag body 1 is typically made of synthetic resin through a molding process and has a hollow rectangular column shape. The above bag body 1 is tightly covered with a cloth or leather cover. A plurality of pockets 2, used for keeping golfer's necessaries, such as golf balls, golf tees, ball makers and gloves, in the golf bag, is exteriorly provided on the side wall of the cover at predetermined positions. A shoulder strap 3 is attached to the side wall of the golf bag, thus allowing a golfer to carry the bag on his shoulder. In the above bag body 1, the top edge of the front wall is designed for being inclined in accordance with different lengths of number three to seven irons. In the same manner, the top edge of the rear wall of the bag body 1 is designed for being inclined in accordance with different lengths of number eight iron to a sand wedge. Due to the inclined top edges of the front and rear walls, two side walls of the bag body 1 are inclined in their top edges. In order to integrate the bag body 1 with the top frame 4 into a single body, the top edge of the bag body 1 covered with the cloth or leather cover is inserted into the girdle 5 of the top frame 4 prior to integrating the top edge of the bag body 1 to the skirt 6 of the frame 4 using a plurality of rivets.

The top frame 4 has six front partition walls 8" on its front wall above the girdle 5, thus forming five front lands 11 between the front partition walls 8" to hold the heads of number three to seven irons in the order of length of the irons. Five club inlet openings 7 are formed inside the five front lands 11, respectively, thus allowing the shafts of the above five irons to be separately kept in the bag. In the same manner, the top frame 4 has six rear partition walls 8" on its rear wall above the girdle 5, thus forming five rear lands 11 between the rear partition walls 8" to hold the heads of number eight and nine irons, a pitching wedge, a sand wedge and a putter in the order of length of the above clubs. Of the five rear lands 11, one land for the putters is horizontal at a half portion and is inclined at the remaining half portion, thus forming an inclined portion 13 capable of freely holding various putters.

A plurality of club inlet openings 7 and 7' are formed inside the five rear lands 11, thus allowing the shafts of the above two irons, the pitching wedge, the sand wedge and the putter to be separately kept in the bag. In the same manner as that described for the primary embodiment, the inlet openings 7' for both the sand wedge and the putter are designed for communicating with each other without having any partition wall between them, thus allowing the shaft of a putter to be more effectively kept in the bag. A longitudinal center opening 10 is formed on the top wall of the top frame 4, thus allowing a plurality of woods to be kept in the bag.

When a plurality of golf clubs are received into the golf bag through the inlet openings 7, the shafts of the clubs are not moved in the bag since the openings 7 are isolated from each other by partition ribs between the openings 7. In such a case, the club heads are stably kept on their lands 11 since the lands 11 are isolated from each other by the partition walls 8". A putter head is caught on the land 11 of the opening 7' at its front portion. In such a case, the rear portion of the putter head is laid on the top wall of the frame 4 at a position free from the center opening 10. Woods are kept in the center opening 10.

FIGS. 7 to 12 show a golf bag in accordance with the third embodiment of the present invention.

As shown in the drawings, the golf bag according to this embodiment comprises a bag body 1 detachably attached to both a top frame 4 and a bottom frame 17.

Figures 7, 7A, 7B:
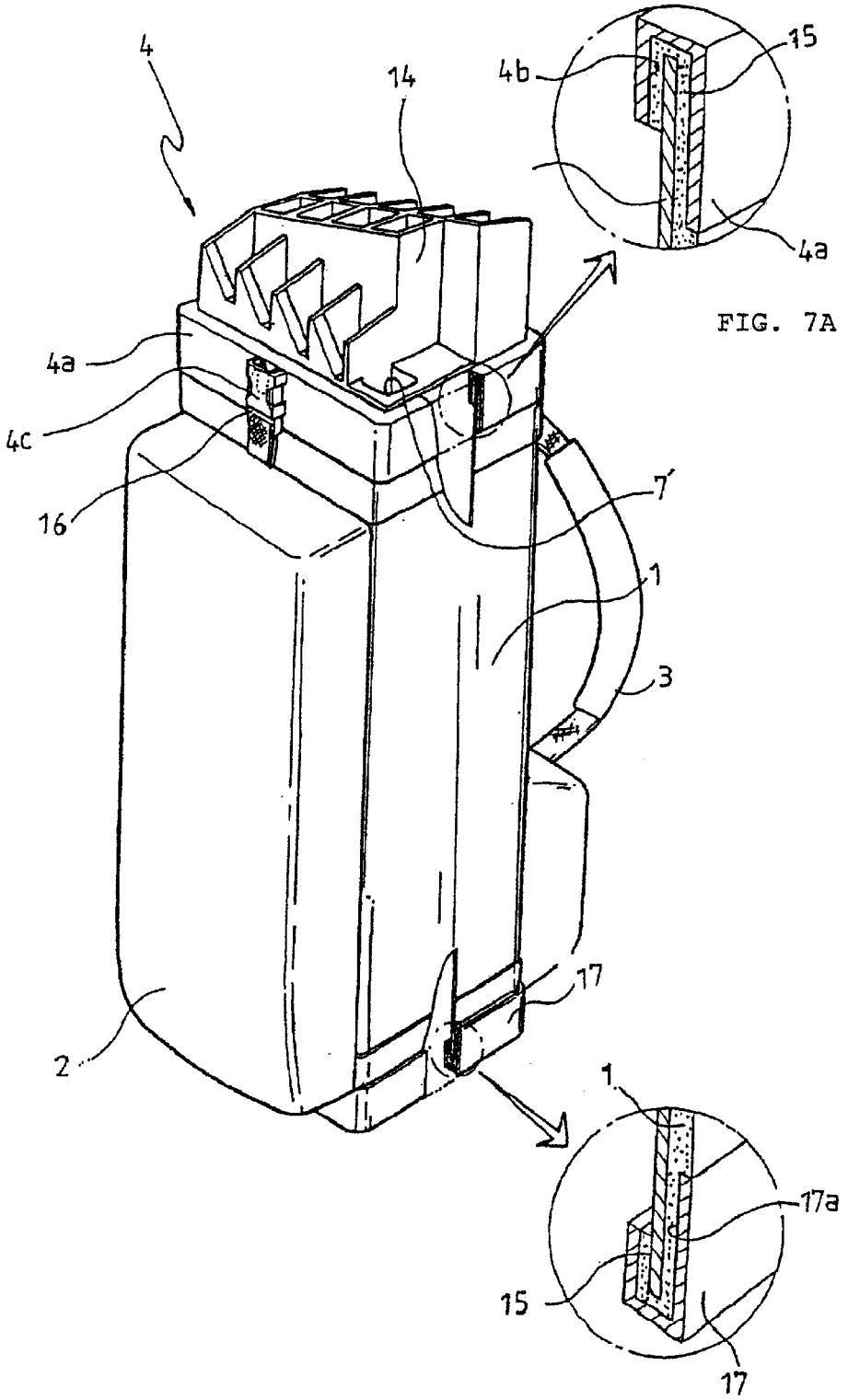
FIG. 7 is a perspective view showing the appearance and assembling structure of a golf bag in accordance with the third embodiment of the present invention.
FIG. 7A is an enlarged view of a detail of construction of the upper end of the golf bag of FIG. 7.
FIG. 7B is an enlarged view of a detail of construction of the lower end of the golf bag of FIG. 7.
Figure 8:
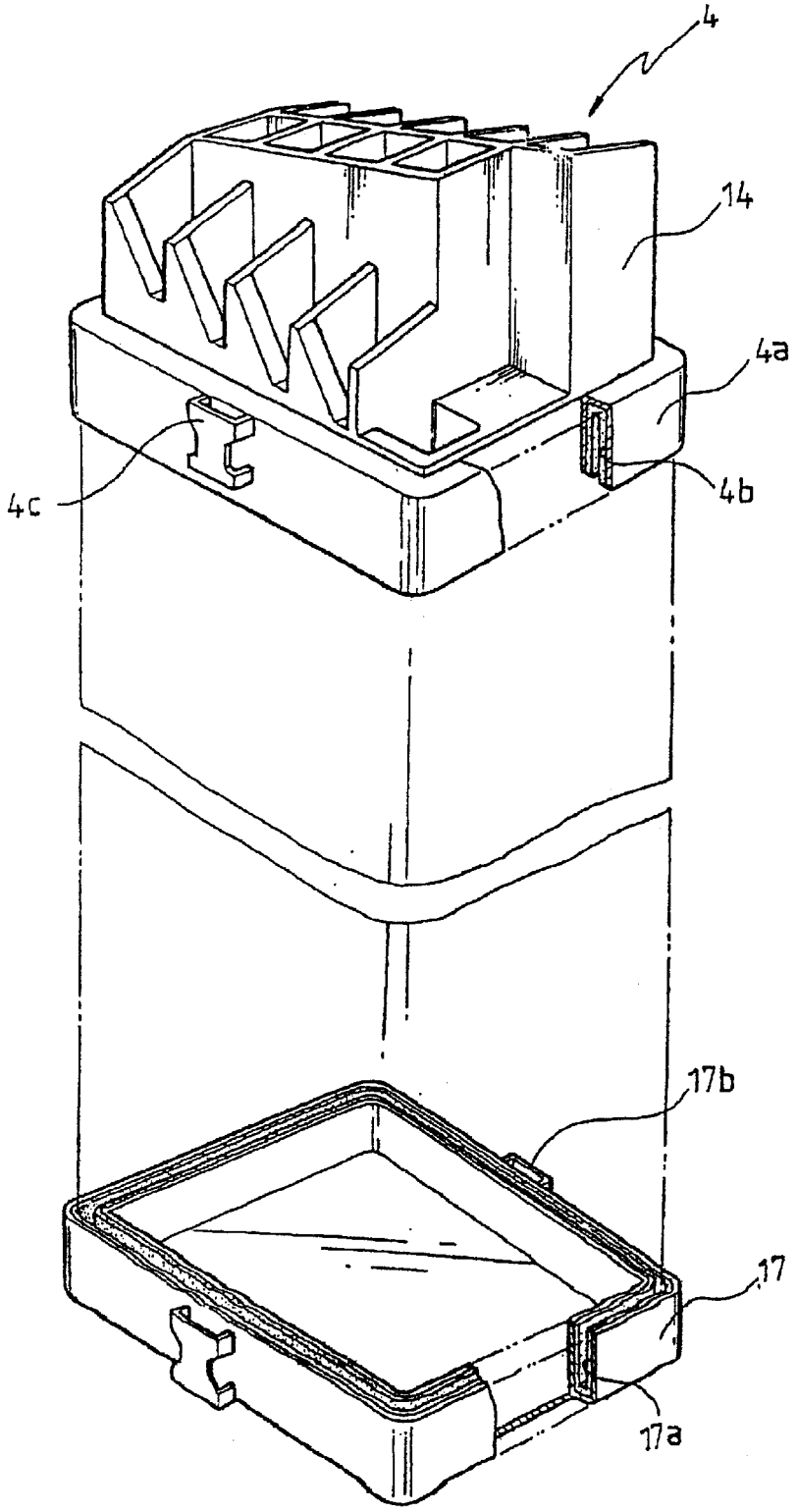
FIG. 8 is a perspective view showing the arrangement of the top and bottom frames in the golf bag of FIG. 7.

As best seen in FIGS. 7 and 8, the above bag body 1 is typically made of synthetic resin through a molding process and has a hollow rectangular column shape with both ends being open. The above bag body 1 is tightly covered with a cloth or leather cover. A plurality of pockets 2, used for keeping golfer's necessaries, such as golf balls, golf tees, ball markers and gloves, in the golf bag, is exteriorly provided on the side wall of the cover at predetermined positions. A shoulder strap 3 is attached to the side wall of the golf bag, thus allowing a golfer to carry the bag on his shoulder. The above bag body 1 is detachable attached to the top and bottom frames 4 and 17 at its top and bottom edges, respectively. Each of the above top and bottom frames 4 and 17 is provided with two clip holders 4*c* or 17*b* at opposite side walls. Of course, the top and bottom edges of the bag body 1 are provided with a plurality of elastic clips 16 at positions corresponding to the clip holders 4*c* and 17*b* of the two frames 4 and 17.

The top frame 4 comprises a fitting part 4*a* and a club holding part 14 which are integrated into a single body. The fitting part 4*a* is made of a hard synthetic resin and has a hollow rectangular configuration. As endless fitting groove 4*b,* having a predetermined width and depth, is longitudinally formed along the lower edge of the part 4*a* as best shown in FIG. 7A. A similar construction is employed for the lower end of the bag as illustrated in the detail of FIG. 7B. Two clip holders 4*c* are integrally and externally formed on opposite side walls of the fitting part 4*a,* respectively. The club holding part 14 is integrally formed inside the fitting part 4*a*.

Figure 9:
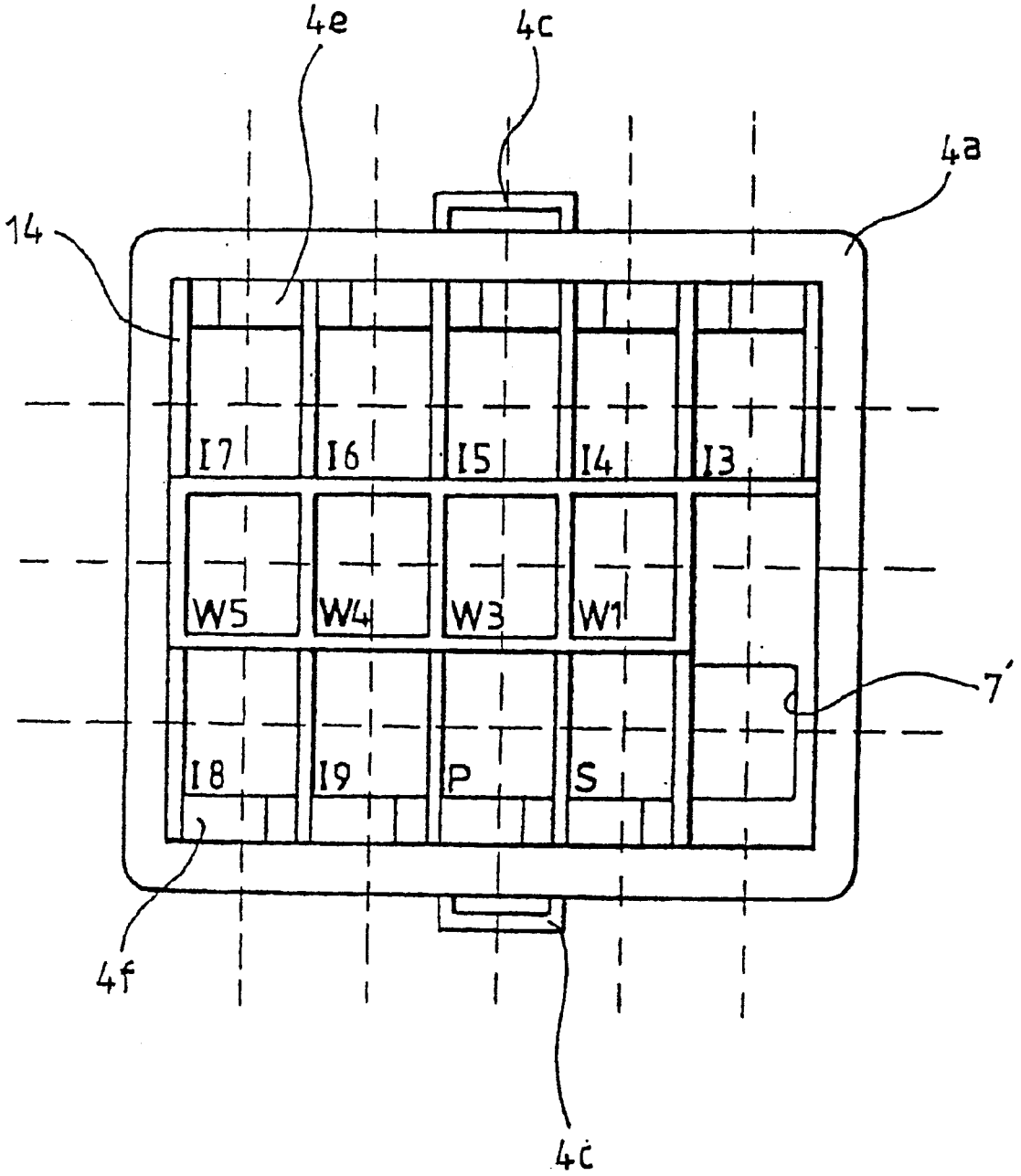
FIG. 9 is a plan view showing the top frame of the golf bag of FIG. 7.
Figure 10:
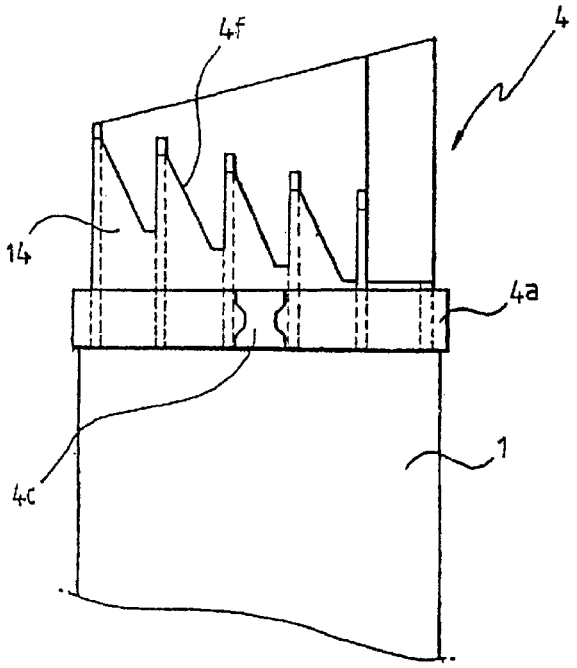
FIG. 10 is a front view showing the top frame of FIG. 9 assembled with a bag body.
Figure 11:
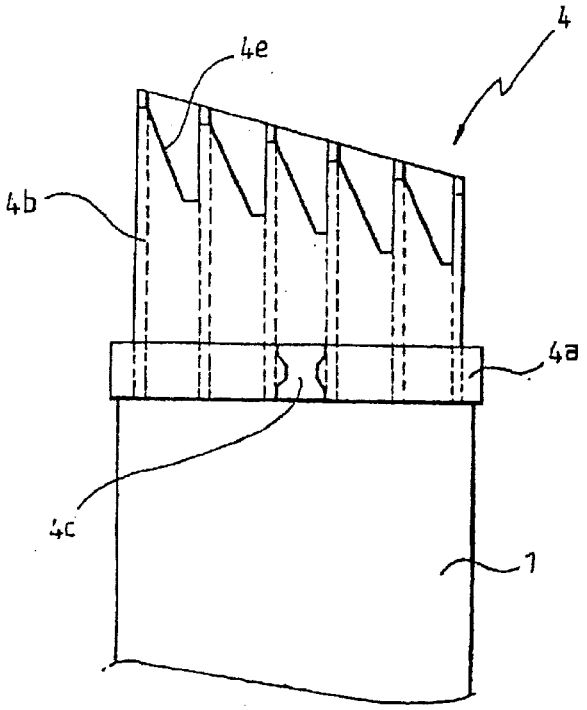
FIG. 11 is a rear view showing the top frame of FIG. 9 assembled with the bag body.
Figure 12:
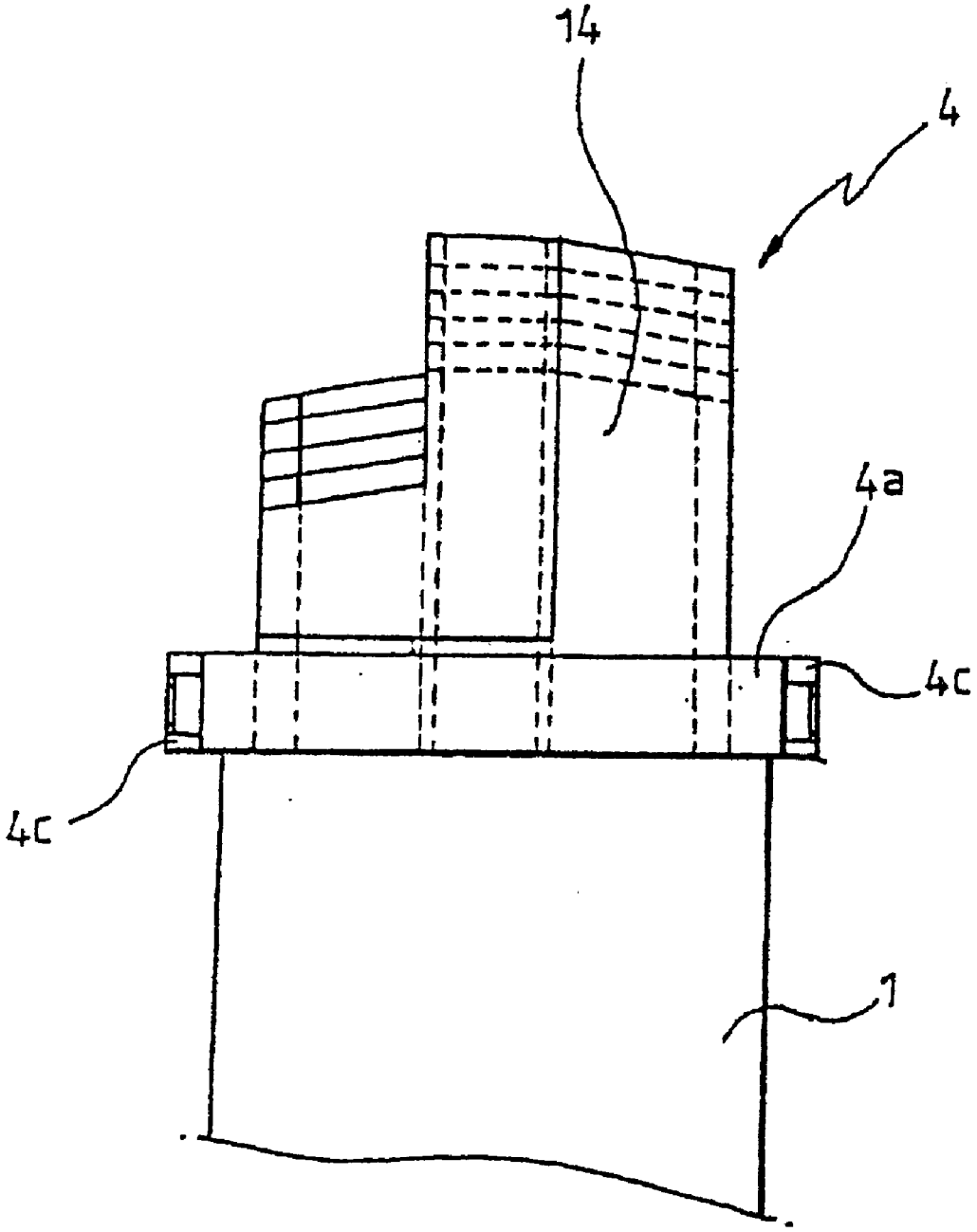
FIG. 12 is a side view showing the top frame of FIG. 9 assembled with the bag body.

That is, the club holding part 14, made of soft synthetic resin, is cast with the fitting part 4*a* into a single structure through an injection molding process. In order to allow the heads of different golf clubs to be neatly adjusted in the part 14 in the order of the size of the club heads, the above part 14 is shaped into a predetermined configuration and is sectioned into 3 lines and 5 rows as best seen in FIG. 9.

As shown in FIGS. 8 to 12, the first line of the club holding part 14 has five club inlet openings I3, I4, I5, I6 and I7 to respectively receive number three to seven irons into the bag. The above five openings I3 to I7, isolated from each other by four partition walls, are gradually inclined downwardly in a direction from the opening I3 to the opening I7 in accordance with different lengths of the three to seven irons. The outside wall of each of the above openings I3 to I7 is cut into a reversed isosceles triangle with the lower apex being flat to form a head holding land having a predetermined width, thus forming a first head hanger 4*e*.

The second line of the above club holding part 14 has four club inlet openings W1, W3, W4 and W5 to respectively receive number one, three, four and five woods, having different lengths, into the bag. The above four openings W1, W3, W4 and W5, isolated from each other by three partition walls and having the same size as that of the openings I3 to I7 of the first line, are respectively positioned to be aligned with the openings I4 to I7. The above openings W1, W3, W4 and W5 are gradually inclined downwardly in the same direction as that of the openings I3 to I7. In the second line, the area, corresponding to the opening I3 of the first line, is completely closed and is horizontally flattened at a position higher than the lower end of the part 14 by a predetermined height.

The third line of the club holding part 14 has four club inlet openings S, P, I9 and I8 to respectively receive a sand wedge, a pitch wedge and number nine and eight irons, having different lengths, into the bag. The above four openings S, P, I9 and I8, isolated from each other by three partition walls and having the same size as that of the openings W1, W3, W4 and W5 of the second line, are respectively positioned to be aligned with the openings W1, W3, W4 and W5. The above openings S, P, I9 and I8 are gradually inclined upwardly in a direction from the opening S to the opening I8 in accordance with different lengths of the two wedges and two irons. The outside wall of each of the above openings S, P, I9 and I8 is cut into a reversed isosceles triangle with the lower apex being flat to form a head holding land having a predetermined width, thus forming a second head hanger 4*f*. In the third line, the area, corresponding to the opening I3 of the first line, is completely leveled with the close area of the second line but opened, thus forming an additional club inlet opening 7' used for receiving a putter into the bag.

The bottom frame 17 is made of a hard synthetic resin and has a rectangular box shape. The above frame 17 is open upwardly and is closed at its bottom. An endless fitting groove 17*a,* having a predetermined width and depth, is longitudinally formed along the top edge of the frame 17. Two clip holders 17*b* are integrally and externally formed on opposite side walls of the frame 17 in the same manner as that described for the clip holders 4*c* of the top frame 4.

As best seen in FIG. 7, the outside wall of each fitting groove 4*b* or 17*a* of the frames 4 and 17 is designed for being higher than the inside wall of said fitting groove. When the bag body 1 is assembled with both frames 4 and 17 at its top and bottom edges, a sponge 15 is tightly interposed between each of the top and bottom edges of the bag body 1 and the groove 4*b* or 17*a* of an associated frame. Due to the above sponge 15, it is possible to elastically assemble the bag body 1 with both frames 4 and 17 into a golf bag as shown in FIGS. 7A and 7B.

In order to assemble the bag body 1 with the two frames 4 and 17 into a golf bag, the top and bottom edges of the bag body 1 are respectively fitted into the fitting grooves 4*b* and 17*a* of the top and bottom frames 4 and 17. In such a case, a sponge 15 is tightly interposed between each of the top and bottom edges of the bag body 1 and the groove 4*b,* 17*a* of an associated frame. After fitting the top and bottom edges of the bag body 1 into the grooves 4*b* and 17*a* of the frames 4 and 17 as described above, the elastic clips 16 of the bag body 1 are elastically fitted into the clip holders 4*c* and 17*b* of the two frames 4 and 17. Therefore, the bag body 1 is detachably assembled with the top and bottom frames 4 and 17 into a golf bag of this invention.

When it is necessary to disassemble the golf bag into the parts: the bag body 1 and the two frames 4 and 17 for the purpose of, for example, cleaning the golf bag, the two frames 4 and 17 are easily detached from the bag body 1 through an inverse process.

When a plurality of golf clubs into the golf bag of the third embodiment, the grip ends of the clubs are held on the bottom wall of the frame 17, while the club heads are stably held on the head hangers 4*e* and 4*f* of the top frame 4, thus being rarely moved in the top frame 4.

As described above, the present invention provides a golf bag provided with a plurality of club inlet openings and club head shields at its top frame. In the golf bag of this invention, a plurality of clubs, such as irons, woods, a pitching wedge, a sand wedge and a putter, are separately and neatly adjusted in the order of different lengths of the clubs. In such a case, the shafts of the clubs are inserted into the bag through the club inlet openings, while the club heads are held in the head shields. Both the shafts and heads of the clubs are thus almost completely prevented from being moved or tangled in the golf bag, so that a golfer easily selects a desired club from the bag prior to hitting a golf ball on the course. The above golf bag also prevents the club heads from colliding against each other, thus preventing the club heads from being damaged. In addition, the golf bag of this invention also allows a golfer to check empty head shields of this bag at a look, so that the golf bag almost completely prevents any club heads from being lost.

Although the preferred embodiments of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A golf bag, comprising:

a bag body; and a top frame externally provided with a fitting girdle for being integrated with a top edge of said bag body into a single body, said top frame having:

a plurality of U-shaped first head shields for keeping heads of number three to seven irons, said first shields being formed along a front wall of said frame in the order of different lengths of said five irons and individually having an opening to receive a club shaft;

a plurality of U-shaped second head shields for keeping heads of number eight and nine irons and a pitching wedge, said second head shields being formed along a rear wall of the frame in the order of different lengths of the two irons and pitching wedge and individually having an opening to receive a club shaft;

a third head shield for keeping heads of both a sand wedge and a putter, said third shield being arranged aside by said head shield for the pitching wedge and being half open to receive a putter head, said third shield also having a single opening to receive a club shaft;

a putter hanger formed on the rear wall of said single opening of the third head shield at a position for the putter head; and a longitudinal center opening formed on a top wall of said top frame to receive a plurality of woods, said central opening being designed so that its inside end does not exceed an area aligned with said putter hanger.

2. A golf bag, comprising:

a bag body with both a top edge of a front wall being inclined in accordance with different lengths of number three to seven irons and a top edge of a rear wall being inclined in accordance with different lengths of number eight and nine irons, a pitching wedge and a sand wedge; and a top frame externally provided with a fitting girdle for being integrated with a top edge of said bag body into a single body, said top frame having:

six front partition walls formed on a front wall above said girdle, thus forming five front lands between said front partition walls to hold heads of the number three to seven irons in the order of length of said irons, with five openings being formed inside said five front lands, thus allowing shafts of said five irons to be separately kept in said bag;

six rear partition walls formed on a rear wall above said girdle, thus forming five rear lands between said rear partition walls to hold heads of number eight and nine irons, a pitching wedge, a sand wedge and a putter in the order of length of the above clubs, with a plurality of openings being formed inside the five rear lands to separately receive club shafts into the bag, with the openings for both the sand wedge and the putter communicating with each other without having any partition wall between them; and a longitudinal center opening formed on a top wall of said top frame to receive a plurality of woods in said bag.

3. A golf bag, comprising:

a bag body made of synthetic resin and having a hollow rectangular column shape with both ends being open, said bag body also having a plurality of external clips, a pocket and a shoulder strap;

a top frame detachably assembled with a top edge of said bag body and comprising:

a fitting part made of hard synthetic resin and having a hollow rectangular configuration, with both an endless fitting groove having a predetermined width and depth and being longitudinally formed along a lower edge of said fitting part and a plurality of clip holders being integrally and externally formed on a side wall of said fitting part; and a club holding part made of soft synthetic resin and cast with said fitting part into a single structure, said club holding part being sectioned into a plurality of lines and rows to neatly adjust a plurality of golf clubs in the order of sizes of club heads; and a bottom frame detachable assembled with a bottom edge of said bag body, said bottom frame being made of a hard synthetic resin and having a rectangular box shape, with both an endless fitting groove having a predetermined width and depth and being longitudinally formed along a top edge of said bottom frame and a plurality of clip holders being integrally and externally formed on a side wall of said bottom frame.

4. The golf bag according to claim 3, wherein said club holding part comprises:

a plurality of first openings formed on a side of said club holding part to respectively receive number three to seven irons into said bag, said first openings being gradually inclined downwardly in a direction from an opening for the number three iron to another opening for the number seven iron;

a plurality of second openings formed on another side of said club holding part to respectively receive number eight and nine irons, a pitching wedge and a sand wedge into said bag, said second openings being gradually inclined upwardly in a direction from an opening for the sand wedge to another opening for the number eight iron; and an additional opening used for receiving a putter into said bag, said additional opening being formed aside by the opening for the said wedge at a position corresponding to the opening for the number three iron.

5. The golf bag according to claim 3, wherein said bag body is fitted into said fitting grooves of the top and bottom frames at its top and bottom edges prior to elastically fitting said clips of the bag body into said clip holders of the top and bottom frames, thus detachably assembling the bag body with the two frames into a single body.

* * * * *